US008043475B2

(12) United States Patent
Shockley et al.

(10) Patent No.: US 8,043,475 B2
(45) Date of Patent: Oct. 25, 2011

(54) HIGH OPACITY TICKETS

(75) Inventors: Theodore B. Shockley, Albany, IN (US); Harris Bacon, Richmond, VA (US); James G. Schmidt, Greenleaf, WI (US); Mark Velicer, De Pere, WI (US)

(73) Assignee: Indiana Ticket Company, Muncie, IN (US)

( * ) Notice: Subject to any disclaimer, the term of this patent is extended or adjusted under 35 U.S.C. 154(b) by 796 days.

(21) Appl. No.: 11/960,218

(22) Filed: Dec. 19, 2007
(Under 37 CFR 1.47)

(65) Prior Publication Data

US 2008/0149289 A1 Jun. 26, 2008

Related U.S. Application Data

(63) Continuation-in-part of application No. 10/872,139, filed on Jun. 18, 2004, now abandoned, and a continuation-in-part of application No. 10/794,387, filed on Mar. 5, 2004, now abandoned, and a continuation-in-part of application No. 10/664,518, filed on Sep. 17, 2003, now abandoned.

(51) Int. Cl.
*D21H 11/14* (2006.01)
*D21H 17/28* (2006.01)
*D21H 17/68* (2006.01)

(52) U.S. Cl. ..... 162/147; 162/175; 162/181.8; 428/131

(58) Field of Classification Search ..... 162/147, 162/175, 181, 8; 428/131
See application file for complete search history.

(56) References Cited

U.S. PATENT DOCUMENTS 257,017 A 4/1882 Keller
(Continued)

FOREIGN PATENT DOCUMENTS

EP 0 373 500 6/1990

OTHER PUBLICATIONS

"Paper Grades," Product Sheet [online], Cook Paper Recycling Corporation, Feb. 10, 2003, [retrieved on Sep. 11, 2010], Retrieved from the Internet via the Internet Archive Wayback Machine: <URL: http://web.archive.org/web/20030210205558/http://www.cookpaper.com/paper_grades/>.*

(Continued)

*Primary Examiner* — Matthew Daniels
*Assistant Examiner* — Dennis Cordray
(74) *Attorney, Agent, or Firm* — Barnes & Thornburg

(57) ABSTRACT

A ticket stock and manufacturing process wherein a pulp is formulated from a blend of recycled furnishes, with added starch for enhancing sheet stiffness and reducing linting and dusting on cut edges of the stock, and clay or other opacifier for enhancing opacity of the stock. A preferred pulp comprises a blend of recycled solid bleached sulfate plate stock, recycled coated soft white, and recycled ground wood furnish such as newsprint or the like. In one embodiment, the blend comprises about 25-50 wt. % recycled solid bleached sulfate plate stock, about 25-50 wt. % recycled coated soft white, and about 15-25 wt. % recycled ground wood furnish. The furnish blend is repulped with minimal mechanical refining, is treated with steam injection for hydrating and softening the fibers, and is formed into a web that is pressed, dried, and soft calendered. The caliper of the resulting stock is about 7 to 9 points and provides a ticket for use in prize redemption in family entertainment centers, arcades, location-based entertainment centers, amusement parks, and similar establishments. The ticket may also be used to conduct drawings, raffles and give-a-ways. The ticket may be formed from a sheet of reply card stock paper having a caliper characteristic in the range of 5 and 11 points.

14 Claims, 4 Drawing Sheets

U.S. PATENT DOCUMENTS

| | | | | |
|---|---|---|---|---|
| 403,113 | A | 5/1889 | Keller | |
| 403,939 | A | 5/1889 | Keller | |
| 426,503 | A | 4/1890 | Keller | |
| 992,557 | A | 5/1911 | Hargis | |
| 1,240,266 | A | 9/1917 | Stoiber | |
| 1,419,066 | A | 6/1922 | Lick | |
| 1,691,455 | A | 11/1928 | Bates | |
| 2,187,685 | A | 1/1940 | Freedman | |
| 2,238,724 | A | 4/1941 | Freedman | |
| 2,293,054 | A | 8/1942 | Freedman | |
| 2,309,398 | A | 1/1943 | Keller | |
| 2,331,316 | A | 10/1943 | Freedman | |
| 2,416,686 | A | 3/1947 | Freedman | |
| 2,430,209 | A | 11/1947 | Boegner | |
| 2,491,807 | A | 12/1949 | Freedman | |
| 2,532,664 | A | 12/1950 | Freedman | |
| 2,571,268 | A | 10/1951 | London | |
| 3,703,779 | A | 11/1972 | Goldman | |
| 3,808,092 | A | 4/1974 | Busker | |
| 3,963,821 | A | 6/1976 | Takeda et al. | |
| 4,071,201 | A * | 1/1978 | Austin, Jr. | 242/598.3 |
| 4,086,317 | A | 4/1978 | Miyabe | |
| 4,143,810 | A | 3/1979 | Greenaway | |
| 4,270,774 | A | 6/1981 | Barnes | |
| 4,376,887 | A | 3/1983 | Greenaway et al. | |
| 4,456,632 | A | 6/1984 | Amberkar | |
| 4,912,080 | A | 3/1990 | Weinstein | |
| 4,916,841 | A | 4/1990 | Dawson | |
| 4,919,758 | A | 4/1990 | Wagle et al. | |
| 4,952,278 | A | 8/1990 | Gregory et al. | |
| 5,055,161 | A | 10/1991 | Hoffman | |
| 5,061,346 | A * | 10/1991 | Taggart et al. | 162/175 |
| 5,138,140 | A | 8/1992 | Siemiatkowski et al. | |
| 5,211,093 | A | 5/1993 | Horniak | |
| 5,223,092 | A | 6/1993 | Grinnell et al. | |
| 5,228,692 | A * | 7/1993 | Carrick et al. | 273/139 |
| 5,314,584 | A | 5/1994 | Grinnell et al. | |
| 5,449,200 | A | 9/1995 | Andric et al. | |
| 5,489,453 | A | 2/1996 | Friesch | |
| 5,546,856 | A | 8/1996 | Neider et al. | |
| 5,578,353 | A | 11/1996 | Drew, III | |
| 5,585,312 | A | 12/1996 | TenEyck et al. | |
| 5,585,321 | A | 12/1996 | Breen et al. | |
| 5,695,107 | A | 12/1997 | Shoemaker, Jr. | |
| 5,895,556 | A | 4/1999 | Ferguson et al. | |
| 5,902,453 | A | 5/1999 | Ruch | |
| 5,919,556 | A | 7/1999 | Barnholtz | |
| RE36,424 | E | 12/1999 | Clement | |
| 6,296,736 | B1 | 10/2001 | Hsu et al. | |
| 6,322,667 | B1 | 11/2001 | McCall et al. | |
| 6,332,953 | B1 | 12/2001 | Singh et al. | |
| 6,391,150 | B1 * | 5/2002 | Berger et al. | 162/4 |
| 6,432,269 | B1 | 8/2002 | Dragner | |
| 6,494,975 | B1 | 12/2002 | Scrymgeour et al. | |
| 6,669,814 | B2 | 12/2003 | Hansen et al. | |
| 6,796,487 | B2 | 9/2004 | Shoemaker, Jr. | |
| 6,843,888 | B2 | 1/2005 | Merrette et al. | |
| 2002/0170693 | A1 * | 11/2002 | Merrette et al. | 162/175 |
| 2004/0241407 | A1 | 12/2004 | Landoll et al. | |
| 2005/0057037 | A1 | 3/2005 | Shockley | |
| 2005/0194780 | A1 | 9/2005 | Shockley | |
| 2005/0279472 | A1 | 12/2005 | Bacon et al. | |

OTHER PUBLICATIONS

Smook, Gary A., Handbook for Pulp and Paper Technologists, 2nd ed, Angus Wilde Publications, 1992, pp. 209, 220 and 225.*

ISRI Institute of Scrap Recycling Industries, Inc., Scrap Specifications Circular 2003: Paper Stock, 2003, ISRI, 5 pages.*

Smook, Gary A., Handbook for Pulp and Paper Technologists, 2nd ed, Angus Wilde Publications, 1992, pp. 209, 225, 228, 264, 266, 273-275.

* cited by examiner

HIGH OPACITY TICKETS

This application is a continuation-in-part of U.S. application Ser. No. 10/664,518 filed Sep. 17, 2003, now abandoned, this application is a continuation-in-part of U.S. application Ser. No. 10/794,387 filed Mar. 5, 2004, now abandoned and this application is a continuation-in-part of U.S. application Ser. No. 10/872,139 filed Jun. 18, 2004, now abandoned.

BACKGROUND AND SUMMARY OF THE INVENTION

The invention relates in general to papermaking, and in particular relates to the manufacture of paper suitable for use as ticket stock used for making redemption tickets of the type commonly dispensed from automated machines in game arcades and the like.

Game arcades often have electronic games that dispense redemption tickets as a reward for having played the game well. Depending on the game score achieved by the player, the game machine dispenses a different number of tickets. The tickets typically can be redeemed for prizes such as toys, stuffed animals, candy, and the like. The game machines generally employ an automated ticket dispenser that dispenses a number of tickets based on the game score. The tickets are supplied in the form of a roll of interconnected tickets separated from one another by perforations. The tickets usually have a printed bar code on one side and may have other indicia and/or graphics on the opposite side. The automated ticket dispenser includes an optical sensor that detects the bar code or other printed marking on each ticket, and in that manner the dispenser is able to count how many tickets are dispensed. Arcades sometimes also include ticket counting machines that operate on a similar principle, such that tickets to be redeemed are fed into the counting machine, which counts the tickets by using an optical sensor.

For proper functioning of the ticket dispensers and ticket counters, and for good aesthetics of the tickets, it is important that the paper or stock making up the tickets have a high opacity so that printed ink on one side of the tickets does not show through to the other side. At the same time, it is desirable for the tickets to have a soft feel in the hand, to have edges that are not so sharp as to pose a risk of cutting the users' hands, to have relatively high strength so they are not easily torn, and to have a highly smooth surface for good printability. Currently available ticket stocks do not always achieve all of these desirable characteristics.

The majority of ticket stocks currently being produced are formed on multiply paper machines, and have a thickness or caliper of about 9.5 to 13 points (i.e., 0.0095 to 0.013 inch). Some ticket stock is also produced as a coated solid bleached sulfate (SBS) sheet with a caliper as low as 7 points, but the coating is essential for achieving sufficient opacity to enable proper functioning of the automated ticket dispensers. Such coated SBS ticket stock generally does not have a desirable soft feel in the hand.

Ticket stock of lower caliper is desirable for improving the ticket yield per unit weight of the papermaking furnish, and for increasing the number of tickets per roll of a given diameter. However, reducing the caliper generally has an adverse impact on some of the other desirable characteristics. For instance, a thinner paper, all other things being equal, has a reduced opacity, a reduced stiffness, and a reduced strength. There is also a certain caliper threshold below which the tickets do not have a good "feel" in the hand, as being too flimsy or insubstantial. It is generally thought that the practical lower limit is about 6.5 to 7 points, as tickets below this caliper level generally feel flimsy and are not favored by consumers.

Additionally, although some ticket stocks are colored, there is a sizeable market for white ticket stock. Such white ticket stock must have a high brightness.

Accordingly, it would be desirable to provide a white ticket stock of relatively low caliper, such as about 7 to 9 points, more preferably about 7 points, having a high opacity, a soft feel, and a highly smooth surface for good printability.

BRIEF SUMMARY OF THE INVENTION

Tickets are widely used for prize redemption in family entertainment centers, arcades, location-based entertainment centers, amusement parks, and similar establishments. Tickets may also be used to conduct drawings, raffles and give-aways.

Organizers of events and companies that dispense tickets typically order tickets by the tens of thousands, and often by the truckload. Beyond the expense of purchasing the actual ticket, ticket-purchasing organizations may expect to pay shipping and storage fees.

The present invention relates to one or more of the following features, elements or combinations thereof. A ticket is illustratively formed from a sheet or strip of a substrate. The substrate is illustratively reply card stock paper. The substrate may have a caliper characteristic in the range of 5 and 11 points. The opacity of the substrate may be below 98%. The substrate may be manufactured and formed into rolls of tickets, or may be manufactured and formed into decks of tickets. Alternatively, the substrate may be manufactured and formed into sheets of tickets or individual tickets. A roll of 2000 tickets may have a diameter of less than 6.5 inches. The roll of 2000 tickets may have a weight of less than one pound. The rolls may be packaged in a container that has smaller dimensions than the previously-known shipping container. A container holding four rolls across may have a smaller side dimension than 13.5 inches.

In another embodiment, a ticket is illustratively formed from a sheet or strip of a substrate. The substrate is illustratively high opacity ticket stock. The substrate has a caliper characteristic in the range of 5 to 7.5 points. The opacity of the substrate is above 98%. The substrate may be manufactured and formed into rolls of tickets, or may be manufactured and formed into decks of tickets. Alternatively, the substrate may be manufactured and formed into sheets of tickets or individual tickets. A roll of 2000 tickets may have a diameter of less than 6.5 inches. The roll of 2000 tickets may have a weight of less than one pound. The rolls may be packaged in a container that has smaller dimensions than the previously-known shipping container. A container holding four rolls in a two-by-two fashion may have a smaller side dimension than 13.5 inches.

The invention addresses the above needs and achieves other advantages, by providing a ticket stock and manufacturing process wherein a pulp is formulated from a blend of recycled furnishes, with added starch for enhancing sheet stiffness and reducing linting and dusting on cut edges of the stock, and with added clay or other opacifier for enhancing opacity of the stock. A preferred pulp comprises a blend of recycled solid bleached sulfate plate stock, recycled coated soft white, and recycled ground wood furnish such as newsprint or the like. In one embodiment, the blend comprises about 25-50 wt. % recycled solid bleached sulfate plate stock, about 25-50 wt. % recycled coated soft white, and about 15-25 wt. % recycled ground wood furnish. Starch can be added in the amount of about 25 to 35 pounds per ton of the finished stock. Clay can comprise about 80 to 120 pounds per ton of the finished stock.

The ticket stock preferably has a caliper of about 7 to 9 points, more preferably about 7 points. The formulation of the pulp leads to an opacity (measured according to the TAPPI 519 method) of at least about 98 percent. The ticket stock has a Parker Smoothness not substantially exceeding about 8 microns, more preferably not substantially exceeding about 6 microns, and still more preferably not substantially exceeding about 5 microns.

A process for making a ticket stock in accordance with the invention entails formulating a pulp from a mixture of recycled furnishes as noted above, and adding starch and clay or other opacifier to the pulp. The recycled furnishes are repulped with minimal mechanical refining or fiber shortening. The pulp is then processed at elevated temperature to hydrate and soften the fibers; this can be accomplished, for example, in a unit that injects steam into the pulp while the pulp is at a high consistency. In the case where the recycled furnish includes some printed furnish, this treatment is also effective to break up ink and other contaminants into very fine particles.

Next, the pulp is fed at a suitable consistency level to a former, which forms a wet web. The former can comprise any of various formers known in the art, including single-ply and multi-ply formers. In one embodiment, a fourdrinier former is employed to form a single-ply web.

The wet web is then dewatered and pressed in a press section. The press section can comprise various types and numbers of presses. In one embodiment, the press section comprises two sequentially arranged presses such as roll presses equipped with dewatering fabrics. The web is then advanced through a drying section. The drying section can be of various configurations. In one embodiment of the invention, the drying section comprises a series of heated drying cylinders that the web is brought into contact with in turn. The web can be urged into firm contact with the cylinders by fabrics.

After drying, the web is fed through a soft nip calendar. The calendaring of the web imparts a smooth surface to the web for good printability and enhances the soft feel of the web.

Additional features of the disclosure will become apparent to those skilled in the art upon consideration of the following detailed description of preferred embodiments exemplifying the best mode of carrying out the invention as presently perceived.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present inventions now will be described more fully hereinafter with reference to the accompanying drawings, in which some but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
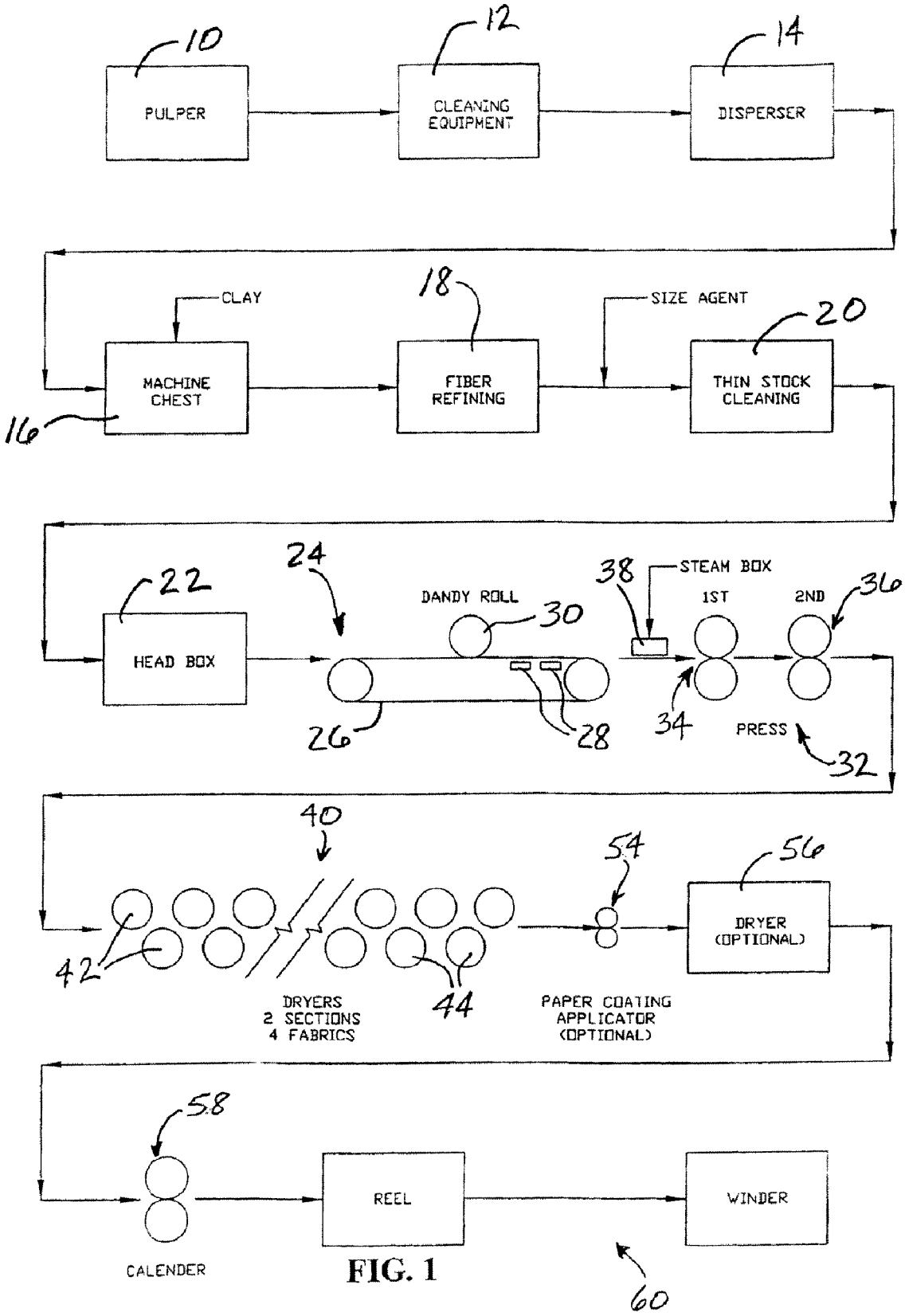
FIG. 1 is a schematic depiction of a papermaking machine and process in accordance with one embodiment of the invention.

With reference to FIG. 1, an apparatus and process for making a paper suitable for use as a ticket stock is illustrated. The process begins by placing a mixture of furnishes into a pulper, or repulper, 10 along with a quantity of water and agitating the mixture to break the furnishes down into a pulp. The mixture of furnishes comprises a blend of recycled furnishes. A preferred mixture comprises a blend of recycled solid bleached sulfate plate stock, recycled coated soft white, and recycled ground wood furnish such as newsprint or the like. In one embodiment, the blend comprises about 25-50 wt. % recycled solid bleached sulfate (SBS) plate stock, about 25-50 wt. % recycled coated soft white, and about 15-25 wt. % recycled ground wood furnish. A particularly advantageous blend comprises about 30 wt. % SBS plate stock, about 50 wt. % coated soft white, and about 20 wt % newsprint. The furnishes advantageously are blank or unprinted, but alternatively one or more can be printed. The pulper 10 preferably repulps the furnishes without any substantial degree of mechanical refining or fiber shortening. In this regard, the pulper preferably comprises a large open metal vessel with a high shear agitator in the bottom. A slurry of pulp at a consistency of 4%-6% solids is formed by feeding dry paper bales along with process white water into the pulper and agitating until the slurry can be extracted through a perforated plate and pumped to a receiving chest for further processing.

After the furnishes are pulped in the pulper 10, the resulting pulp is cleaned using suitable cleaning equipment 12 to remove certain undesirable contaminants such as plastic, metal, glass, wood splinters, and dirt. The cleaning equipment comprises liquid cyclone cleaners which continuously remove particles of high specific gravity and contaminant materials such as sand, glass, paper clips, and staples, and also includes barrier screens which are designed to continuously remove oversized particles from the pulp stream prior to refining and formation.

The pulp is then fed into a disperser 14 that injects steam into the pulp while the pulp is at a high consistency (e.g., approximately 12%-20%). The disperser is a horizontally oriented, pressurized cylindrical vessel with a screw type feeder designed to keep slurry moving continuously through the vessel. The injected steam softens and hydrates the fibers of the pulp. Additionally, if any of the furnish used is printed, the steam injection breaks the inks down into very small particles which remain in the finished product but can barely be seen with the naked eye. Pigment in the form of high-brightness clay can be added later in the process to offset the loss of brightness caused by the presence of ink.

The pulp is fed from the disperser into a machine chest 16 where additional water is added to the pulp to reduce the consistency to a level suitable for paper forming. Additionally, one or more additives can be added to the pulp at this stage. For example, advantageously an amount of clay, liquid opacifier, or other opacifying agent can be added to the machine chest 16 for enhancing the opacity of the finished paper. In one embodiment, clay is added in an amount of about 80 to 120 pounds per ton of the finished paper stock.

Next, a process of fiber refining 18 can be performed using suitable equipment such as fractionating units or the like, to achieve a pulp having fiber lengths in a desired range. Such fractionating units and processes are known in the art and hence need not be described in detail herein. Advantageously, the pulp after the refining step 18 has developed sufficient bonding sites on the fiber cell walls for strength development with minimum fiber length reduction. Following the refining step, a size agent such as starch can be added to the pulp as shown. Starch can be added in the amount of about 25 to 35 pounds per ton of the finished stock.

The pulp advantageously is then subjected to a thin stock cleaning process 20. This process consists of pumping dilute slurry (<1% solids) through a bank of multiple high velocity centrifugal cleaners to remove a large percentage of remaining fine particle contaminant materials (approx. 70%-90% removal rate).

The pulp is then fed into a headbox 22 of a fourdrinier former 24. The headbox injects a stream of pulp onto a traveling wire 26 of the former. Dewatering elements 28 beneath the wire drain some of the water from the web formed on the wire. Advantageously, a Dandy roll 30 (i.e., essentially a roll with a wire screen wrapped about it) contacts the upper surface of the formed web to assist in web formation.

The web formed in the fourdrinier former 24 is advanced to a press section 32 for further dewatering. The press section can comprise various types and numbers of press devices, including roll presses, extended-nip or shoe presses, or the like. In the illustrated embodiment, the press section comprises a first roll press 34 and a second roll press 36. Each of the roll presses includes a pair of dewatering fabrics (not shown) between which the wet web is sandwiched. The fabrics with the web therebetween are passed through the nip between the two rolls of the press. The pressure exerted on the fabrics and web causes water to be transferred from the web into the fabrics, as known in the art. The linear nip load exerted on the fabrics and web is generally higher in the second press 36 than in the first press 34. For example, the nip load in the first press advantageously can be about 400 lb/linear inch (PLI) while the load in the second press can be about 1400 PLI.

The web can be treated by a steam box 38 prior to the press section 32 in order to heat the wet sheet and improve pressing and drying efficiency.

Figure 2:
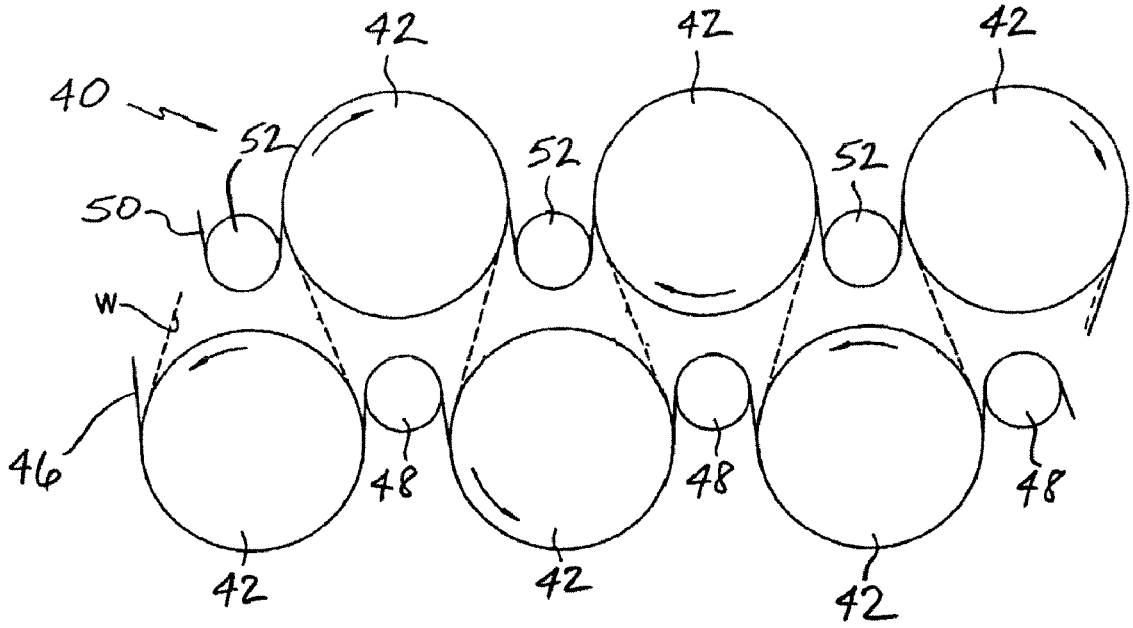
FIG. 2 is a schematic illustration of one cylinder group of the drying section in accordance with one embodiment of the invention.

After pressing, the web is fed through a dryer section 40 for thermally drying the web to a desired low moisture content. The dryer section is made up of a first group of heated drying cylinders 42 and a second group of heated drying cylinders 44. Each group of cylinders includes a pair of fabrics for urging the web against the cylinders. FIG. 2 shows the first group of cylinders 42 in greater detail. The cylinders are arranged so that the web W passes in serpentine fashion about each cylinder in turn, whereby one side of the web contacts the first cylinder, the other side of the web contacts the next cylinder, and this alternate cycle repeats for the next two cylinders, etc. A first fabric 46 is arranged to pass around a first set of the cylinders 42. Guide rolls 48 guide the first fabric 46 from one cylinder to the next and allow the fabric to wrap about a substantial proportion of the circumference of each cylinder. The web W is arranged so that it is between the first fabric 46 and each cylinder 42. A second fabric 50 is arranged to pass around a second set of the cylinders 42, and guide rolls 52 guide the second fabric from one cylinder to the next and allow the fabric to wrap about a substantial proportion of the cylinder circumferences.

The second group of drying cylinders 44 likewise has a pair of fabrics that operate in the way described above.

With reference again to FIG. 1, after the web exits the drying section 40, it can optionally be coated on one or both sides in a coating applicator 54. The applied coating(s) can then be dried in a dryer 56. Advantageously, however, a ticket stock in accordance with preferred embodiments of the invention does not have any coating.

Next, the web is passed through a calender 58. The calender advantageously comprises a soft nip calender wherein one of the calender rolls has a surface that is deformable so that the nip formed between the deformable roll and the opposing roll is somewhat elongated rather than being a single tangent point between two rigid rolls. The calender is preferably heated. A suitable calendering temperature is between about 400.degree. F. and about 500.degree. F. Calendering of the web in the soft nip calender imparts a smooth surface to the web for good printability, and enhances the soft feel of the web.

Figure 3:
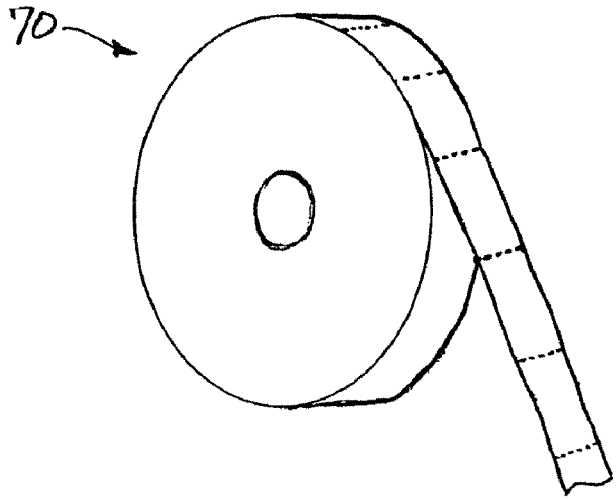
FIG. 3 shows a roll of redemption tickets formed of a stock in accordance with an embodiment of the invention.

Finally, the finished web is wound into a roll in a reel-up 60. The roll of finished stock typically is shipped to a converter where it is converted into redemption tickets or other products. In the case of redemption tickets, the stock is unwound from the roll, slit, perforated, printed, and wound into individual rolls of redemption tickets such as the roll 70 shown in FIG. 3.

The stock in accordance with preferred embodiments of the invention is manufactured to have a caliper of about 7 to 9 points, more preferably about 7 points. The formulation of the pulp leads to an opacity (measured according to the TAPPI 519 method) of at least about 98 percent for the finished stock, more preferably at least about 99 percent. The stock preferably has a Parker Smoothness, on at least one of its surfaces, not substantially exceeding about 8 microns, more preferably not substantially exceeding about 6 microns, and still more preferably not substantially exceeding about 5 microns.

As an example of a stock made in accordance with one embodiment of the invention, a white ticket stock was manufactured from 30 wt. % SBS plate stock, 50 wt % coated soft white, and 20 wt. % blank newsprint. Clay was added to the pulp in the amount of about 100 pounds per ton of the finished stock. Starch was added in the amount of about 28 to 31 pounds per ton of finished stock. The stock was manufactured using the above-described process, without the optional coating. Five rolls of the stock were prepared, and three samples from each roll were tested for various properties. The average of all samples was computed for each measured property. The average properties are listed below:

Caliper: 6.84 points

Basis Weight: 32.65 lbs/1000 ft.sup.2

Density: 4.78 lbs/point (per 1000 ft.sup.2)

Tensile Modulus (MD): 47 lbs.

Water Drop (TAPPI RC-70): 103 secs. (back), 85 secs. (top)

Taber Stiffness: 18.9 g-cm (MD), 10.2 g-cm (CD)

Parker Smoothness: 5.97.mu. (top), 4.29.mu. (back)

Minolta Color (avg. of top and back): 84.72 (L), 1.77 (A), 2.51 (B)

Opacity (TAPPI 519): 99.61%

The finished stock was clean and bright, with little or no specs or particles that could pick off the surface when printed. The stock had a matte finish and a generally soft feel in the hand. Slit edges were clean and substantially free of linting or dusting.

Figure 4:
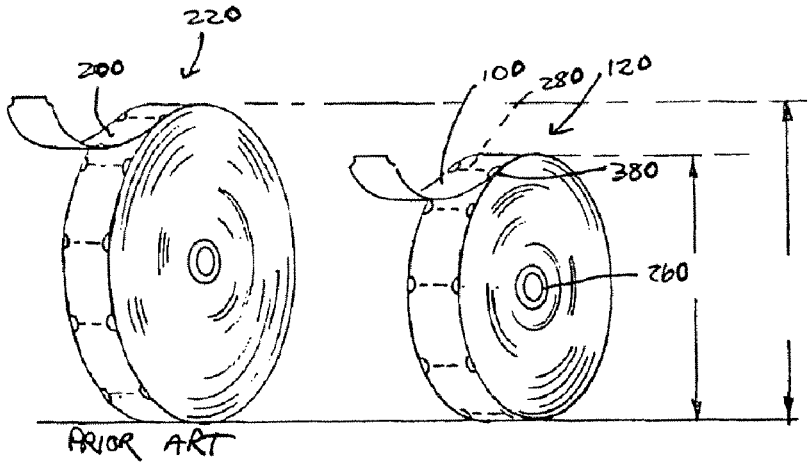
FIG. 4 shows a perspective view of a prior art roll of tickets and the smaller, new roll of tickets made according to the present disclosure.

A ticket 100, as can be seen in FIG. 4, may be illustratively used for admission to or for point of purchase applications at any of the following: social events, festivals, carnivals, amusement places, parking lots, academic functions, religious functions, and athletic events, among others. Such a ticket 100 may be available in a wide variety of sizes, shapes, and colors, and may or may not have markings relating to the event. Ticket 100 may be punched, perforated, numbered, or die cut. Ticket 100 can be specifically designed for hand issue, machine issue, mechanical collection, collection and accounting by weight, and/or collection and accounting by audit.

Figure 6:
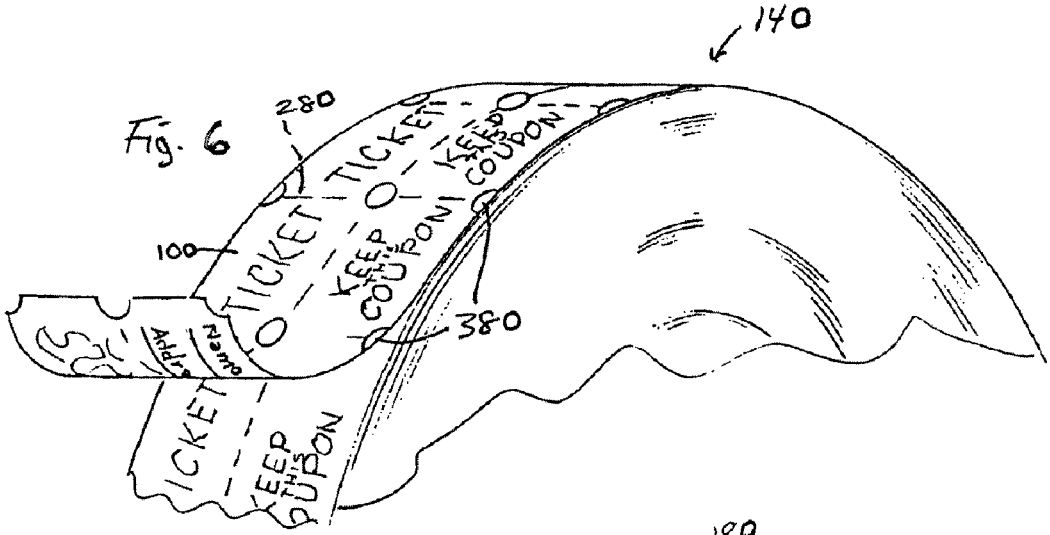
FIG. 6 shows a perspective view of a portion of a double roll.

The illustrative tickets 100 may be provided on a roll 120 of 2000 continuous tickets, commonly called "roll tickets" in the industry, as can be seen in FIG. 4. In such an embodiment, tickets 100 are configured to be unrolled from the roll 120 and separated along perforations 280 in increments desired by the dispensing party. Alternatively, tickets 100 may be formed in groups of two or more, and can be dispensed two or more at a time from a "double roll" 140, as can be seen in FIG. 6. A double roll comprises 2000 sets of two tickets, and can be used, for example, in a raffle or lottery scenario. However, it should be understood that other configurations and embodiments are within the scope of the disclosure, and multiple tickets may be rolled adjacent each other. Furthermore, any number of tickets may be provided on a roll, and the tickets could alternatively be grouped in strips or sheets, or may be presented individually or in any other manner known in the industry.

Figure 5:
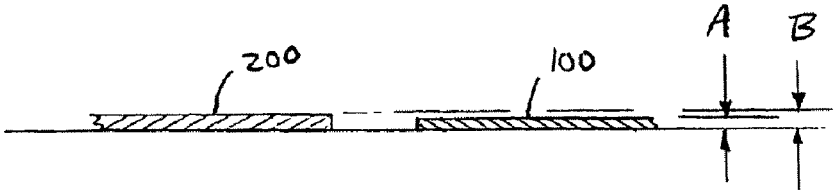
FIG. 5 shows a front elevation view of an end of a prior art ticket and an end of a ticket made according to the present disclosure.

The common ticket 200, which has been known in the art for years, uses a substrate of "common ticket stock" paper having a caliper characteristic of approximately 9.5. Typically, the common ticket stock is comprised of ticket bristol paper, and has an illustrative thickness B, as can be seen in FIG. 5. In contrast, ticket 100 is illustratively printed on a stock of paper that is considered "return postcard" or "reply card" stock paper. Such reply card stock having the same length and width dimensions may have a thickness A (as can be seen in FIG. 5). The caliper range may be between 5 and 11 points. The illustrative reply card stock has a caliper of 7. Common ticket stock is comprised of ticket bristol paper, and has an illustrative thickness B, as can be seen in FIG. 5. In contrast, ticket 100 is illustratively printed on a stock of paper that is considered high opacity ticket stock paper. Such high opacity ticket stock having the same length and width dimensions may have a thickness A (as can be seen in FIG. 5). The caliper range may be between 5 and 7.5 points. The illustrative high opacity ticket stock has a caliper of 7. Tickets are illustratively formed to have a width of one inch and a length of two inches, although other dimensions are within the scope of the disclosure.

Additionally, the opacity of a paper may be considered. Common ticket stock typically has an opacity of 99% or greater. The illustrative reply card stock has an opacity of less than 98%. Such reply card stock having a caliper between 5 and 11 points and/or having an opacity below 98% can be ordered from paper supply companies such as International Paper, headquartered in Stamford, Conn., and Boise Cascade headquartered in Boise, Id. The common ticket stock is much thicker and heavier than the high opacity ticket stock presently disclosed. The illustrative high opacity ticket stock has an opacity of greater than 98%, while having a caliper range of between 5 and 7.5 points. Such high opacity ticket stock can be specially ordered from paper supply companies using the characteristics discussed herein.

It should be understood that while the illustrative substrates are reply card stock paper and high capacity ticket stock paper, other substrates providing the opacity and caliper characteristics suggested are within the scope of the disclosure. For example, the substrate may be a polymer-based material.

Figure 8:
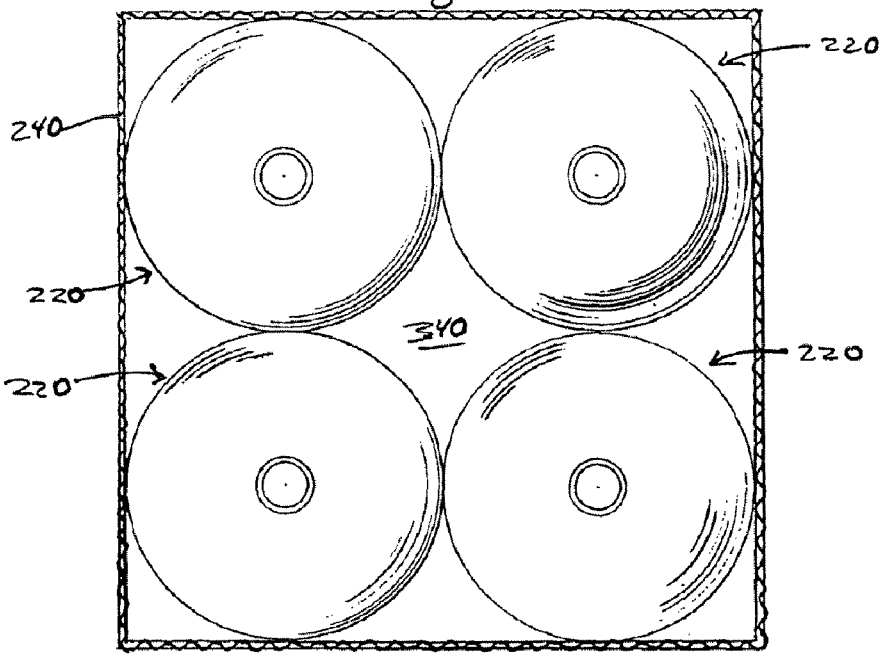
FIG. 8 shows a top view of a container packed with the prior art rolls of tickets.
Figure 9:
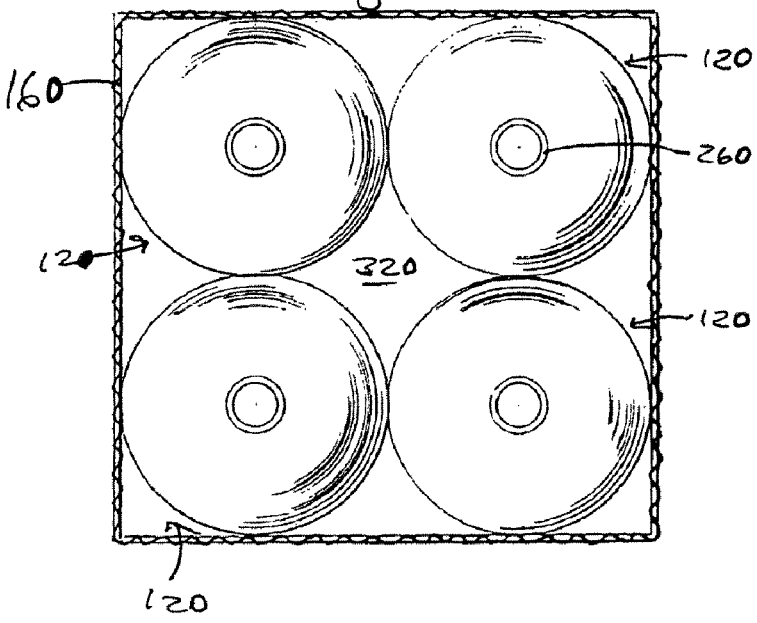
PRIOR ART Fig. 9
FIG. 9 is a top view similar to that of FIG. 5, showing a container packed with rolls of tickets made according to the disclosure.

Use of the reply card stock and high capacity ticket stock described provides a ticket 100 having a substantially smaller thickness A than the thickness B of common ticket 200 constructed of common ticket stock, as demonstrated in FIG. 5. The smaller thickness also provides a ticket roll 120 of 2000 tickets that has a substantially smaller diameter than the common ticket roll 220 of 2000 tickets, as can be seen in FIG. 4. Illustratively, a common ticket roll 220 has a diameter of approximately seven (7) inches, and the ticket roll 120 according to specification has a diameter of approximately six (6) inches. The smaller diameter of ticket roll 120 compared to ticket roll 220 allows a box or container 160 of ticket rolls 120 to be shipped and stored in a smaller container 160 than a box or container 240 of ticket rolls 22, as can be seen by comparing the dimensions of containers 160 and 240, shown in FIGS. 8 and 9. The smaller dimension of container 160 allows more containers 160 to be shipped in a given amount of space, i.e. a truckload, and allows more ticket rolls 120 to be stored in a given amount of storage space. Illustratively, container 16 has side dimensions of less than 13.5 inches.

The high opacity of greater than 98% prevents bleeding or burn-through of ticket dispensing sensors. Such sensors are typically optical sensors and misreadings can occur when lower opacity stock paper is used. A typical optical sensor is used for ticket-counting purposes by utilizing the combination of a light beam and sensor positioned on opposite sides of the strip of tickets being dispensed, the light sensor "reading" when the light shines through an aperture or notch 38 formed in the strip of tickets 10. In lower opacity and/or caliper characteristics, such ticket-counting by light sensors may be impaired.

Figure 10:
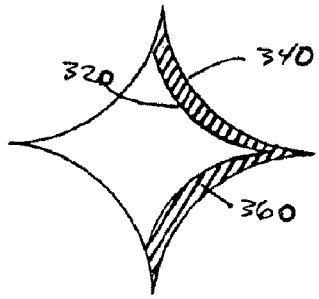
FIG. 10 is a top view of the space formed between four rolls, showing the space saved when the rolls are made according to the present disclosure.

A container 160 shipping ticket rolls 120 made according to the present disclosure is also a more efficient means of shipping ticket rolls because the space 320 between rolls 120 is of smaller dimension than the space 340 between rolls 220. By shipping less air and the same number of tickets, the shipping is more efficient. FIG. 10 illustrates the space saved by using rolls 120 of the present disclosure. The cross-hatched area 360 of FIG. 10 illustrates the shipping space saved when utilizing the presently disclosed rolls 120.

Use of reply card stock or high capacity ticket stock can also provide a ticket 100 having less weight. A common single-ticket roll 220 of 2000 tickets, as shown in FIG. 4, weighs approximately 1.10 pound. A ticket roll 120 of 2000 tickets according to the specification weighs approximately 0.65 pound. Because shipping costs are commonly calculated at least partially based on the weight of the shipment, the lighter weight of the ticket rolls 120 permits a savings on shipping costs to a consumer. Single-ticket rolls 220, such as those shown in FIG. 4, are illustratively shipped in containers 240 having 40 ticket rolls 220. When such single-ticket rolls 220 are manufactured from common ticket stock, the approximately weight of container 240 is forty-seven (47) pounds. When single-ticket rolls 120 are manufactured from the illustrative reply card stock, the approximate weight of container 160 is twenty-eight (28) pounds. Common double-ticket rolls of 2000 tickets weigh approximately 2.35 pounds each, and double rolls 140 according to the disclosure weigh approximately 1.35 pound each.

It is within the scope of the disclosure to provide rolls of any number of tickets. For example, a double roll of 1000 tickets may be provided (not shown). If such a double roll were manufactured from common ticket stock, the diameter would be approximately five (5) inches and the weight would be approximately 1.1 pound. If the double roll were manufactured from the illustrative reply card stock, the diameter would be approximately 4.375 inches and the weight would be approximately 0.65 pound. If the double roll were manufactured from the illustrative high opacity ticket stock, the diameter would be approximately 4.375 inches and the weight would be approximately 0.90 pound.

Figure 7:
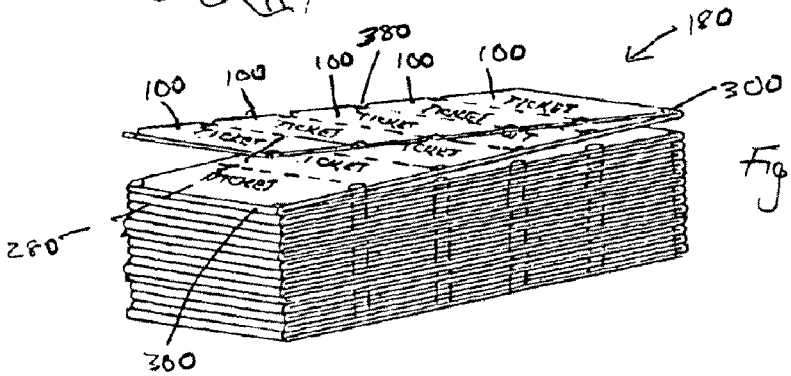
FIG. 7 shows a perspective view of a deck of folded tickets.

The present disclosure is not limited to tickets on rolls, but can also be applied to sheet tickets, folded decks 180 of tickets (as can be seen in FIG. 7), and any other type of ticket known in the art. One use of folded decks 180 is that of redemption tickets, wherein the tickets are dispensed from a game of skill or chance for redemption of a prize. When decks 180 of tickets 100 are used in such a format, it may be necessary to reconfigure the ticket-counting device associated with the ticket dispenser. For example, a typical ticket-counting device (not shown) uses the combination of a light beam and sensor positioned on opposite sides of the strip of tickets being dispensed, the light sensor "reading" when the light shines through an aperture or notch 380 formed in the strip of tickets 100. In some opacity and caliper characteristics disclosed herein, such ticket-counting by light sensors may be impaired. In the alternative, the light sensor may be configured to read a "dark" spot on the ticket 100, rather than a light shining through a notch 380. In such an embodiment, a dark line may be printed across a ticket where the ticket passes under the ticket-counting device, and the notch 380 may be omitted from the ticket 100. However, it should be understood that the described embodiment is merely one example of how a ticket-counting device may be configured, and other examples are within the scope of the disclosure.

It is within the scope of the disclosure to provide a ticket with a light-sensor-triggering marking imprinted thereon. Such a light sensor could be used as a ticket counter.

A method of manufacturing tickets is also disclosed. The method includes the steps of unwinding a portion of a roll of reply card stock paper, feeding the unrolled portion through a printer, cutting the paper to form strips of paper, and perforating the strips of paper to form separable tickets therebetween. The method may include rolling tickets 100 on a tube 260 (visible in FIGS. 4 and 9) in a roll 120 of 2000 tickets 100. Alternatively, the method may include forming decks 180 of tickets, typically accordion-folded with five tickets 10 disposed between each fold line 30, as can be seen in FIG. 7. Decks 180 are illustratively packaged in sets of 3000 tickets, although it is within the scope of the disclosure to combine any number of tickets to form a deck.

A method of shipping tickets is also provided by the disclosure. The method includes the steps of providing rolls of 2000 in a container measuring less than 14 inches on each side.

What is claimed is:

1. A ticket formed from a substrate having a caliper between 5 and 7.5 points and an opacity of greater than 98%, and wherein the substrate is a white ticket stock manufactured from about 30 wt. % SBS plate stock, about 50 wt % coated soft white, and about 20 wt. % blank newsprint with clay added to the pulp in the amount of about 100 pounds per ton of the finished stock and starch added in the amount of about 28 to 31 pounds per ton of finished stock.

2. The ticket of claim 1 wherein the ticket has ends with at least one end having a row of perforations adapted for separation from another ticket.

3. A roll of tickets comprising:

a tube, a plurality of tickets wrapped around the tube, the plurality of tickets having interconnected ends defining rows of perforations therebetween, the plurality of tickets being formed from a substrate having a caliper between 5 and 7.5 points and an opacity of greater than 98%, and wherein the substrate is a white ticket stock manufactured from about 30 wt. % SBS plate stock, about 50 wt % coated soft white, and about 20 wt. % blank newsprint with clay added to the pulp in the amount of about 100 pounds per ton of the finished stock and starch added in the amount of about 28 to 31 pounds per ton of finished stock.

4. The roll of tickets of claim 3, wherein the roll comprises 2000 tickets.

5. The roll of tickets of claim 4, wherein the diameter of the roll is less than 6.5 inches.

6. The roll of tickets of claim 3, wherein the caliper is 7 points.

7. The roll of tickets of claim 3, wherein the opacity is approximately 99%.

8. The roll of tickets of claim 3, wherein the roll comprises 1000 tickets.

9. The roll of tickets of claim 8, wherein the diameter of the roll is less than 4.5 inches.

10. A paper ticket comprising a substrate having a caliper of about 7 to 9 points and formed from a pulp comprising a mixture of recycled solid bleached sulfate plate stock, recycled coated soft white and newsprint, the pulp further comprising starch for enhanced stiffness and reduction of linting and dusting on cut edges of the ticket, and an opacifier enhancing the opacity of the ticket to at least a TAPPI 519 opacity of at least 98% and a Parker Smoothness not substantially exceeding about 8.0 microns, wherein the substrate further comprises about 25-50 wt. % recycled solid bleached sulfate plate stock, about 25-50 wt. % recycled coated soft white and about 15-25 wt. % newsprint.

11. The ticket of claim 10, wherein the ticket comprises a single ply.

12. The ticket of claim 10, wherein the starch comprises about 25-35 lb/ton of the pulp.

13. The ticket of claim 10, wherein the opacifier comprises clay.

14. The ticket of claim 13, wherein the clay comprises about 80 to 120 lb/ton of the pulp.

* * * * *